United States Patent [19]

Fallos

[11] 3,944,209

[45] Mar. 16, 1976

[54] HIGH SPEED DOCUMENT HANDLER

[75] Inventor: George Fallos, Easton, Pa.

[73] Assignee: Bell and Howell Company, Phillipsburg, N.J.

[22] Filed: Jan. 15, 1974

[21] Appl. No.: 433,498

[52] U.S. Cl. ..... 271/4; 271/10; 271/34; 271/69; 271/121; 271/167

[51] Int. Cl.[2]... B65H 3/06; B65H 3/46; B65H 5/02; B65H 29/20

[58] Field of Search ..... 271/10, 121–125, 271/3–7, 34, 35, 37, 110, 116, 149, 150, 272–275, 188, 69, 80, 167, 169

[56] References Cited

UNITED STATES PATENTS

| | | | |
|---|---|---|---|
| 928,637 | 7/1909 | Davidson | 271/116 |
| 2,224,886 | 12/1940 | Tyler | 271/4 |
| 2,278,518 | 4/1942 | Kenney et al. | 271/69 X |
| 2,614,837 | 10/1952 | Cuthbert | 271/121 |
| 2,652,248 | 9/1953 | Johnson | 271/116 |
| 2,759,729 | 8/1956 | Hedlun | 271/110 X |
| 2,779,593 | 1/1957 | Doerner | 271/121 |
| 3,415,509 | 12/1968 | Tyburski et al. | 271/188 |

*Primary Examiner*—Evon C. Blunk
*Assistant Examiner*—Bruce H. Stoner, Jr.
*Attorney, Agent, or Firm*—Griffin, Branigan and Butler

[57] ABSTRACT

Disclosed is a document handler and feeder device for performing high speed separating and transporting of documents, such as business forms. The document handling unit is equipped with friction type feed rollers and a lipped contour plate over which documents must pass. The feed rollers contact and transport a foremost document from a gravity-feed document hopper. High speed tracking belts are mounted over grooves or tracks, which extend along a track plate and through the lip of the contour plate. The feed rolls force the leading edge of the foremost document into the lip where the document engages the bottom side of the belts so that it is nipped between the belts and the contour plate causing the document to move into the tracking grooves. In order to provide ready access to the tracking plate area, the entire tracking belt drive assembly is pivotable upwards about a pivot pin located adjacent the feed roller shaft.

25 Claims, 10 Drawing Figures

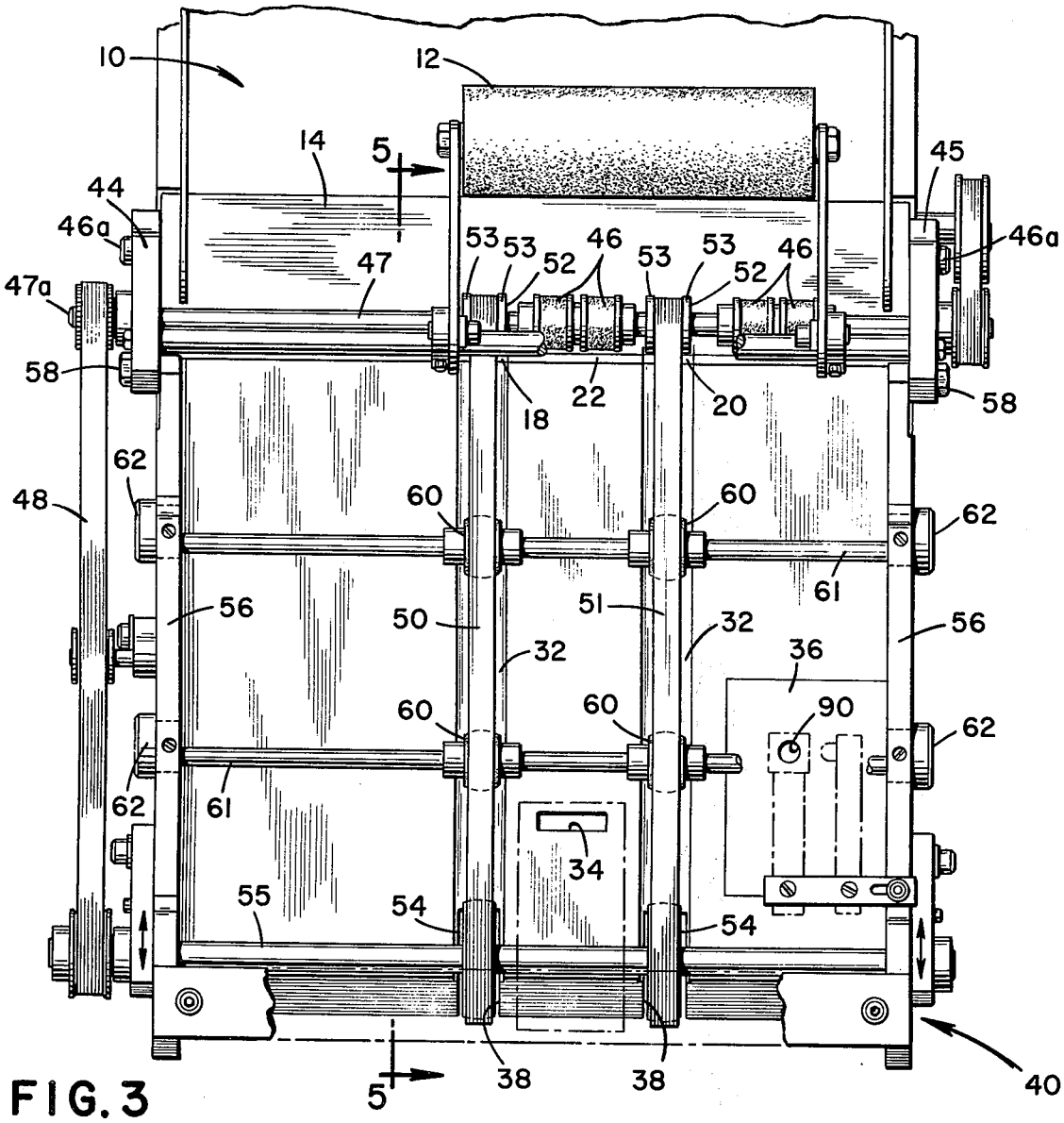
FIG. 3
FIG. 4
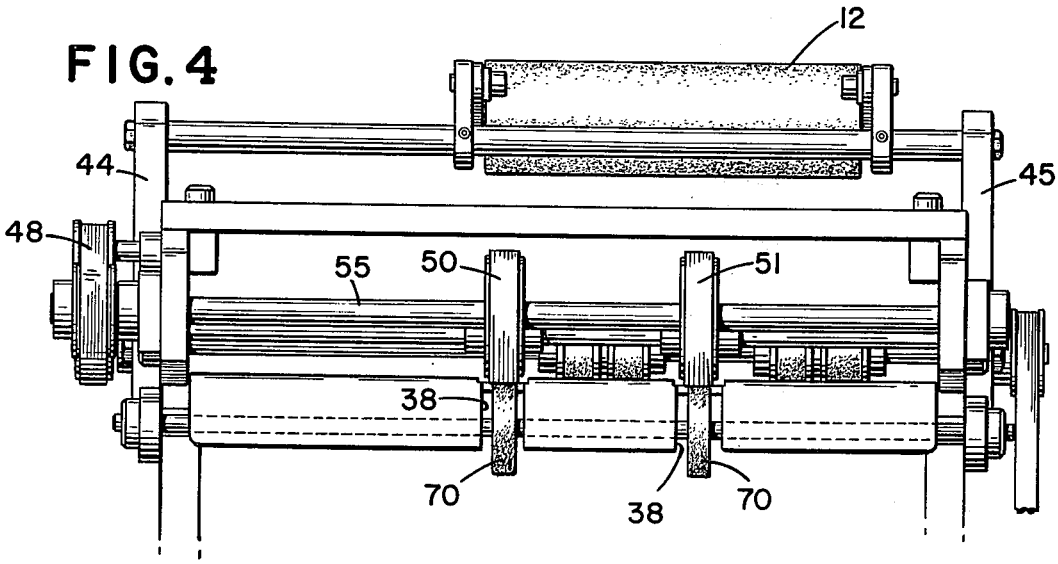

40
50
54
55
56
60
61
62
70
9
32
77
45
58
53
47
52
22
14
24
10
28
26
18
16
30

HIGH SPEED DOCUMENT HANDLER

BACKGROUND OF THE INVENTION

The invention relates to sheet feeding and delivering apparatus. In particular, it relates to a document handler and feeder device for accomplishing efficient single separation of documents from a hopper supply, and skewless high speed transport of such documents.

Current high speed document feeding apparatus exhibit tendencies to misfeed and to feed "doubles." Another prevailing problem is misalignment (skew) of documents after they have been separated from a stack and are being transported.

Hence, for efficient handling of documents, a high speed document handler is needed which accomplishes consistent single separation of stacked documents and high speed transport of these documents with minimal misalignment. Whereupon, it is an object of this invention to provide a high speed document handler capable of separating a single document from a stack in a consistent manner without producing "missing" or "multiple feeding;" and it is another object to provide a high speed document handler which is capable of maintaining documents aligned during high speed transport.

Because of the intricacies of high speed feeding apparatus, even slight force imbalances create document jamming in a transport assembly. Consequently, it is a further object to provide a high speed document handler having easy access to its actual transporting areas to clear document jams.

Another object is to provide an improved type of feed roller.

Still another object is to provide a high speed document handler including adjustable components to adapt the assembly to documents having varied surface characteristics and thickness.

SUMMARY OF THE INVENTION

In accordance with principles of this invention, the objects as set forth are attained by providing an inclined document supply hopper equipped with feed rolls and a nitrided contour plate at its lower end. A roller or plate deflector is set to maintain the documents, such as cards or checks, in an upright, but backwardly sloping position. Mounted just before and above the surface of the contour plate are feed rollers which make initial transporting contact with the foremost document in a stack. A fixed "working" portion of the contour plate is a lip or ledge through which there are two grooves. These grooves mate with a second set of grooves which extend the entire length of a document-transport tracking plate.

Mounted adjacent the feed rollers is a set of tracking belts which are set into the grooves of the contour plate lip and, they too, run the length of the tracking plate. Pressure rollers are provided on the tracking belt assembly to vary the depth of the belts in the grooves. Also, the entire belt assembly is movable fore and aft to provide adjustment of clearance between the feed rolls and the contour plate lip. The feed rolls and tracking belts are driven by separate driving means, so that a desired ratio between their speeds can be maintained, and so that the feed roller can be operated at a slower speed. The entire tracking belt assembly is pivotable upwards to provide easy access to the tracking plate area to clear possible document jams.

BRIEF DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed on illustrating principles of the invention.

In the drawings:

FIG. 3 is a partial top view of a high speed document handler illustrating the feed rollers and tracking belts, as well as the hold back roller and the belt tension adjustment device;

FIG. 4 is a rear view of a high speed document handler, depicting the extension of the tracking belts into the tracking plate grooves and the driving connection between the tracking belts and ejection rollers;

DESCRIPTION OF A PREFERRED EMBODIMENT

Figure 1:
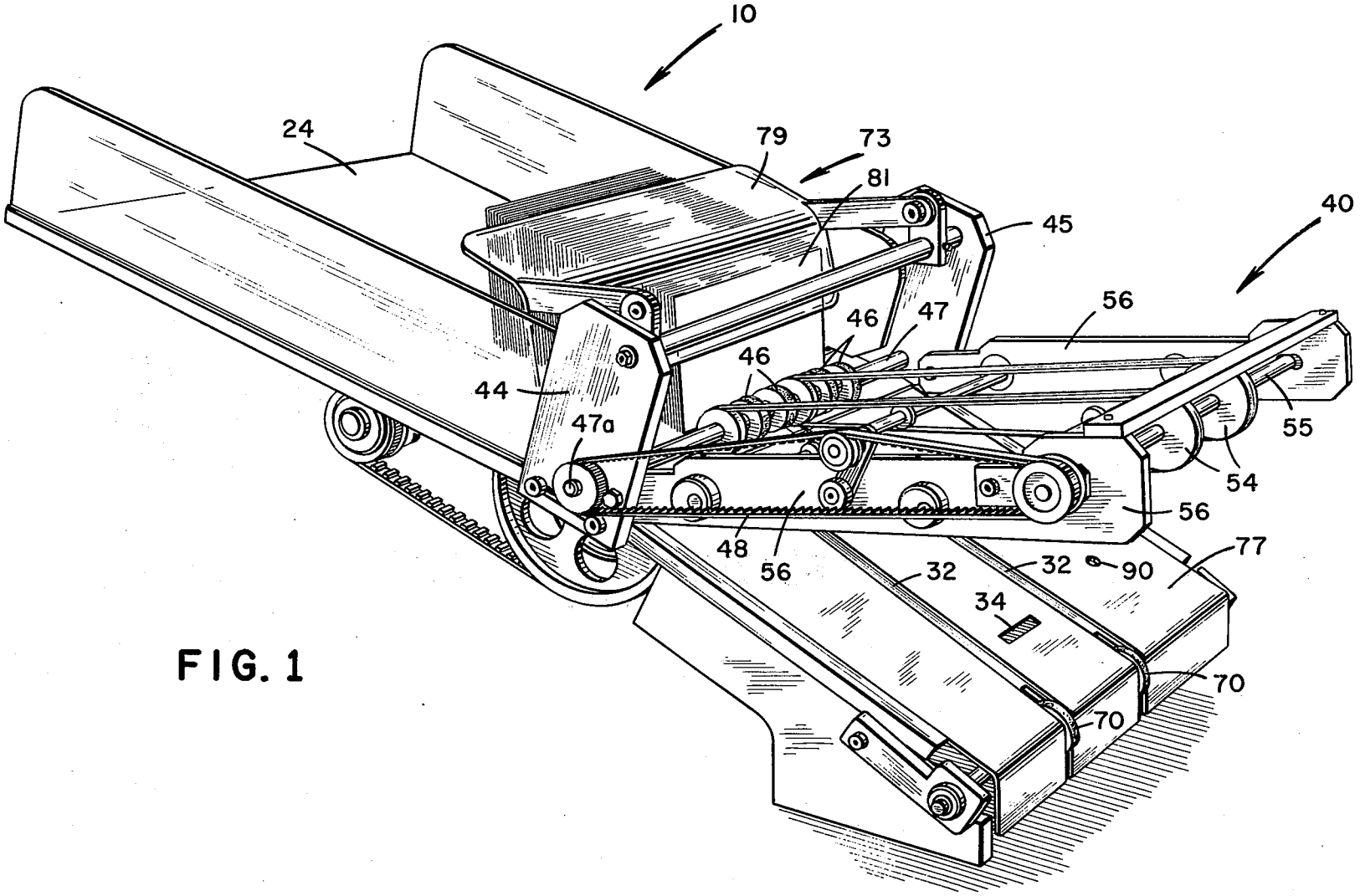
FIG. 1 is a side pictorial view of a high speed document handler according to the invention, including hold back plate and bent hopper plate embodiments.

Referring to the elements of the invention as embodied in the drawings, numeral 10, in FIG. 1, generally represents a document stack hopper equipped with hold back plate 73 which serves to hold documents, such as cards, or checks, in a backwardly sloping position in the hopper to make an angle of recline with respect to a perpendicular to the bottom of the hopper. The front portion 81 of the hold back plate is set at an angle slightly less than the angle of recline of the held documents. That is, it is more nearly perpendicular to the bottom of the hopper. The top portion 79 of the plate 73, on the other hand, is set at an angle slightly greater than the hopper's angle of incline from horizontal. Thusly shaped, the hold back plate offers very low frictional resistance to documents during the feeding operation.

Figure 2:
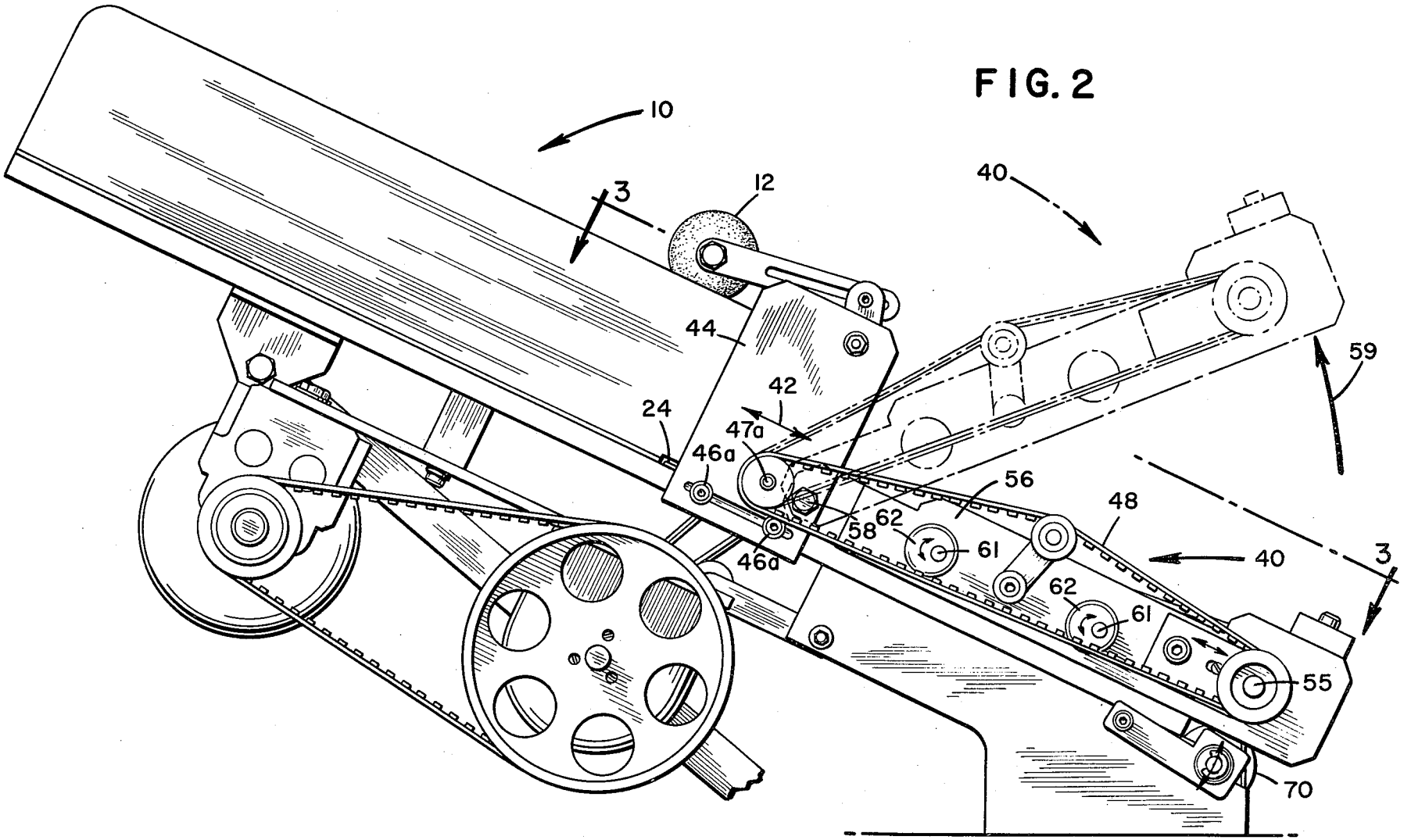
FIG. 2 is an overall side view of a high speed document handler, particularly illustrating the pivotable tracking belt assembly.

FIG. 1 also illustrates one embodiment of the angular relationship between a hopper plate 24 and tracking plate 77. The hopper plate here is set at about 12° from horizontal, as compared to about 25° from horizontal for the tracking plate. This arrangement tends to further reduce adverse frictional forces during the feeding operation. FIG. 2 shows an arrangement with hopper and tracking plates set at the same 25° angle.

Figures 5, 6, 7, 8A, 8B, 9:
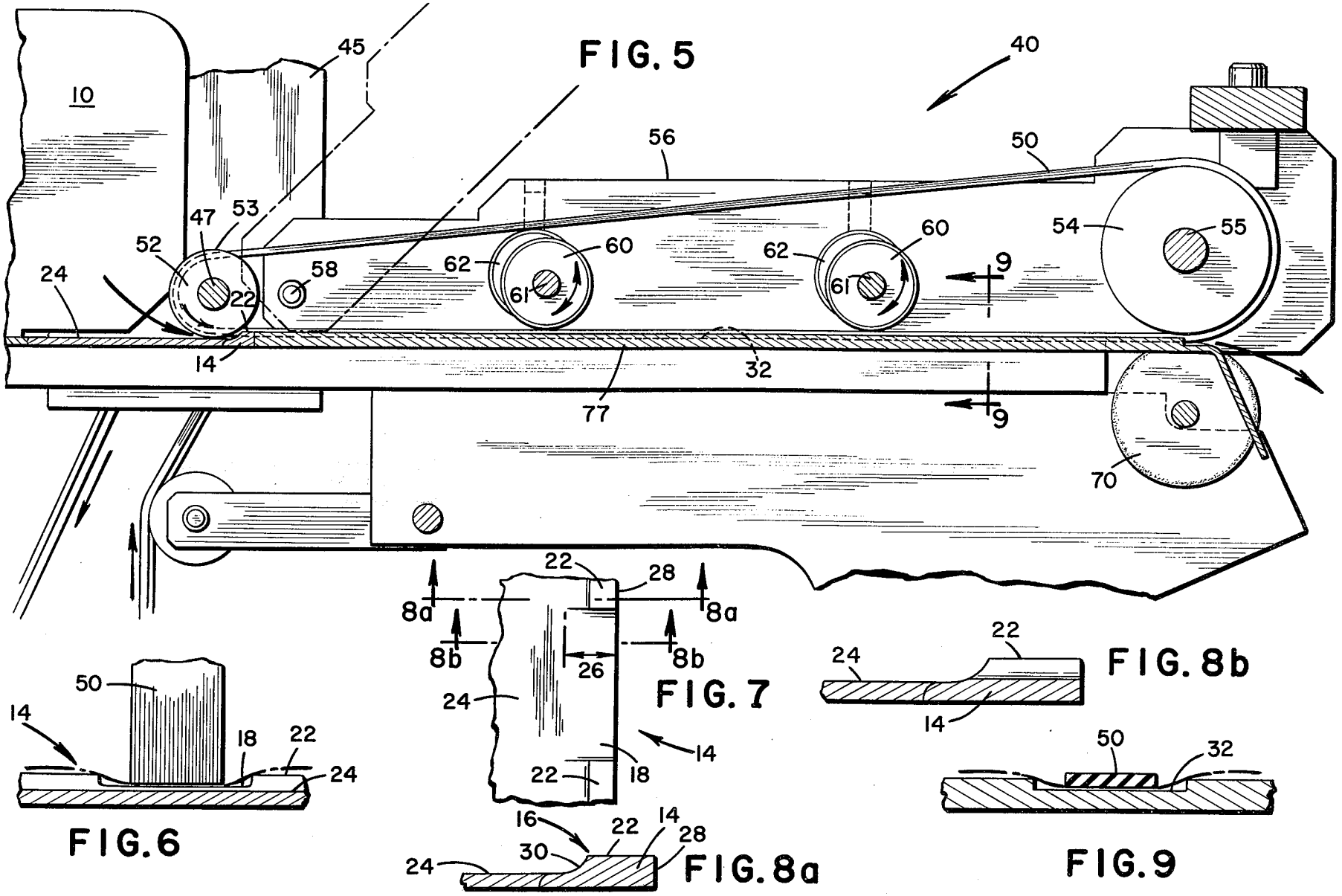
FIG. 5 is a partial side view of a high speed document handler showing the tracking belts extending into the grooves of the contour plate lip and tracking plate, and the adjusting means which determine belt depth.
FIG. 6 is a fragmentary view illustrating the relationship of the tracking belts and contour plate.
FIG. 7 is a fragmentary top view of the contour plate lip including one of its cutout grooves.
FIGS. 8*a* and 8*b* are enlarged side fragmentary views of the contour plate featuring its lip construction when viewed in section through non-grooved and grooved portions thereof respectively.
FIG. 9 is a fragmentary view illustrating the relationship between the tracking belts and the grooves of the tracking plate.

Set in the lowermost portion of the inclined hopper is a contour plate 14 which includes lip 16 (FIG. 8*a*). The surface of the contour plate is nitrided rather than chrome plated, as has been the customary surfacing on hopperbottoms. Inasmuch as a chromed surface is more highly polished than a nitrided surface, it would be expected that a nitrided surface would introduce greater frictional engagement between a fed document and a hopper surface such as that of the contour plate. In this regard, the coefficient of friction for paper on a surface that is chrome plated is about .16, whereas the same surface when nitrided exhibits a coefficient of friction of about .25. Nevertheless, tests show that the nitrided surface on the contour plate of the instant invention allows for higher feed speeds than can be obtained with a more highly polished surface such as chrome. In this regard, the dynamic angle of repose, the angle, during operation, at which a document's component of gravity equals its frictional force with a surface, has been found to be about 9° for a chromed surface. This angle is approximately 14° for a similar structure with a nitrided surface. This seeming contradication can possibly be explained by the reduction of static electricity by the nitrided surface. This static electricity builds up on the chromed surface and serves to restrict document movement. In addition, a nitrided surface exhibits more favorable wear characteristics than a chromed surface.

Grooves 18 and 20 (FIGS. 3 and 6) are cut into the lip 16 about two-thirds of the way from the top edge 22 of the lip to the upper surface of the hopper plate 24 which acts as a reference surface for various contour plate parameters having critical significance in connection with some of the invention's more detailed aspects. As illustrated best in FIGS. 7 and 8, these grooves extend the full width 26 of the lipped portion from its front surface 28 to a point on its rear radius 30 commensurate with the depth of the lip.

Fluted feed rollers 46 (FIG. 1) are driven by a feed roll shaft 47 which, in turn, is driven through a suitable clutch mechanism by a toothed drive-belt 48. These feed rollers are shaped somewhat like a series of common thread spools. That is, they have a cylindrical body portion with driving rims extending outwardly therefrom as shown in FIG. 1. It is these driving rims or fluted portions that make the initial contact with the foremost document in the hopper-held stack where the cards are jointly restrained by the hold-back plate 79 and the lip 16. In this respect, the fluted rollers are mounted adjacent the radius 30 of the lip and serve to pull the foremost document downwardly and bend it across the lip. Through the use of fluted rollers rather than conventional solid rollers, the pull power of the feed rolls is enhanced. This result is accomplished because of the increased "angle of wrap" between the document and the feed rolls which results in an increase in pull power. In this respect, fluted rolls have been found to exhibit at least five times more pulling power than the solid rollers per inch width of the roller's peripheral surface.

Also mounted on shaft 47 are tracking belts 50 and 51 (see FIG. 3) which ride in idlers 52 that include rims 53 which extend outwardly beyond the surfaces of the belts and prevent the belts from making initial contact with the foremost document. These tracking belts extend down into grooves 18 and 20 in the contour plate lip and run the entire length of tracking plate 77 also having grooves 32 which are matingly aligned with the contour plate's grooves. The tracking belts are mounted on a belt assembly 40 that is removably fastened on top of the track plate, so that it is adjustable fore and aft in the direction of arrow 42 in FIG. 2. The belt assembly is comprised of pivot plates 44 and 45 (FIG. 3) that are affixed to the main frame by adjustable fasteners 46*a*.

As also shown in FIG. 3, the lower ends of the tracking belts ride on belt drive sheaves 54 which are mounted on belt drive shaft 55 that is also driven by belt 48. In this regard, the tracking belt drive sheaves are dimensioned so that the linear speed of the belts is about twice the peripheral speed of the feed rolls 53 mounted on shaft 47. The belt drive shaft 55 is mounted between subframe elements 56 which are pivotably mounted on frame elements 44 by pins 58 at the hopper end of the assembly. Thus, the entire subframe is pivotable upwardly as indicated by arrow 59 in FIG. 2. This easy swing-away motion of the tracking belt assembly allows access to the tracking plate area in order that possible jams can be removed. In addition, to facilitate feed roll replacement, the tracking belt assembly is pivoted about pins 58 instead of shaft 47. This eliminates bearing assemblies which would be necessary if the subframe were pivoted on the feed roll shaft. The absence of such bearing connections greatly facilitates removal and replacement of feed rolls.

As best illustrated in FIG. 5, belt-pressure rolls 60 are mounted on shafts 61 whose ends are, in turn, mounted in the subframe members 56 by means of eccentrics 62. These belt-pressure rollers are situated inside of the tracking belts 50, which, as noted, are located in direct alignment with and extend into tracking grooves 32 in the tracking plate as shown in FIG. 9. Rotation of the eccentrics 62 adjusts the pressure of the belt-pressure rolls 60 upon belts 50, and, accordingly, adjusts the tension of belts 50 and the depth to which these tracking belts are permitted to extend into the tracking grooves 32.

In the above regard, although the drawings illustrate two eccentric shafts 61, an alternate embodiment, not shown, uses only a single such eccentric shaft assembly and employs adjustable arms having one end attached to the shaft and a roller mounted on the other end thereof to substitute for the second set of belt pressure rolls 60 shown in FIG. 3. In this manner only a single eccentric adjustment is required.

In either of the belt-pressure embodiments just described, fine adjustment of the depth of the tracking belts permits ideal transport conditions to be set for a particular type of document being handled. In this regard, while some degree of forced distortion of a document into the grooves by the tracking belt permits high speed transport with a minimum of document skew, too much distortion of a document into the grooves would tend to create bending of the document, thus separating it from a flat position on the tracking plate and subjecting it to adverse aerodynamic forces which promote a skewing problem.

FIG. 4 depicts the exit end of the belt transport assembly. At this end, the driven tracking belts 50 and 51 engage elastomeric idler ejection rollers 70 which are set within ejection roll cutouts 38 in the tracking plate, coextensive with the grooves. These idler rollers are adjustable up and down and extend upwardly through the grooves in the tracking plate to put light pressure on the tracking belts 50 and 51.

The tracking plate 77 also is provided with cutouts such as 34 and 36, as illustrated in FIG. 3. Opening 36 accommodates a detector such as a photocell 90 for counting the number of documents passing thereover. It may be further stated the non-used, but exposed, portion of the track plate may be used at any point to accommodate a device (electronic or sensing) to serve the users' specific requirements for high speed feeding of documents.

In operation, documents, such as cards or checks, which are to be fed from a stack held by hopper 10 are initially contacted by the fluted feed rollers 46. The friction maintained between the feed roll and a foremost document is greater than the friction between the document being fed and a subsequent document. Consequently, the foremost document slides over the next document. However, in order to maintain a greater frictional force between and a subsequent document, it is important that the fed document be gradually accelerated. If the feed rolls are rotated at too fast a speed, the coefficient of sliding friction between the feed rolls and the documents tends to drop to the point where the rollers merely slip rather than feed. Therefore, the feed rollers are driven at a relatively slow speed in comparison to the high speed transport accomplished by the tracking belts, as will be discussed below.

After the feed rollers initially bend the foremost document and pull it across radius 30 of the contour plate lip portion, the document is engaged by tracking belts 50 and 51 which are driven at about twice the speed of the feed rolls. Once the document has begun to slide over its next subsequent document its feed speed can be safely accelerated without creating "doubles." Prior to the time of engagement of the belts with the fed document (initially moved by the feed rollers) rims 52 and 53 on the tracking belt idlers prevent the document from contacting the belts. This allows the document to be accelerated from the slower speed of the feed rolls to the higher speed of the belts. As the document approaches the speed of the belts, the feed rolls exert somewhat of a drag force on the document which serves to slightly retard its acceleration at least until the document has moved a distance corresponding to its length. In this manner, the document's acceleration is relatively uniform throughout its initial motion from a stationary position at the document stack to the high speed of the belts themselves.

The radius 30 on lip 16 and the incline of the hopper 10 are such that it is a bit difficult for the document being fed to move upwardly to the top 22 of lip 16 in FIG. 8. However, the feed rolls need only move the document about 0.4 inches before the document is brought into engagement with the tracking belts. In this respect, the radius 30 of the leading edge of the lip is preferrably about one-fourth the radius of the driving flute or rims of the feedrolls; and the height of the lip 16 above the reference surface 24 is preferrably about two-thirds the radius 30 (one-sixth the radius of the driving flutes). Similarly, the depth of the grooves 18 and 20 preferrably is about 75 percent of the lip height (one-eighth of the radius of the driving flutes) depending on whether the documents to be fed are card stock, for example, or documents of much thinner composition. Similarly, the radius 30 can be varied between about half to twice that described above, also depending upon the weight of the documents handled. The designated sizes, however, have been found to be preferable, since they result in satisfactory performance over a wide range of document stocks. The width of the grooves cut through the lip of the contour plate is also significant. Preferrably, the width should be no more than about 25 times its depth and no less than about 3 times its depth with the ratio therebetween preferrably about 14; and a given belt is preferrably about two-thirds the width of its grooves. This preferred range is dictated by the forces acting upon the document as it is being fed.

As noted, belts 50 and 51 extend into grooves 18 and 20 cut through the lip. Hence, when the lead document is intercepted from the feed rollers during its initial feeding, the belts distort the document downwardly into the grooves. This distortion provides a greater than normal frictional force between the document and the belts, so that the next document does not also pass. Consequently, the lip grooves act as an additional deterrent to doubles. In other words, during the time the foremost document is being driven upwardly toward the top of the lip by the feed rolls, until it is acted on by the tracking belts and distorted into the grooves 18 and 20, the succeeding document is held back by radius 30 and does not "see" the distortion or additional frictional forces on the preceding document. Hence, there is little tendency for the succeeding document to follow its predecessor; whereupon, there is a greatly reduced tendency for the instant structure to feed "doubles."

As noted above, the feed rolls are adjustable fore and aft, so as to adjust the initial point at which the documents are brought into engagement with the lip; and also the point at which the document are brought into engagement with the tracking belts. The vertical clearance between the feed rollers and the plate surface 24 is fixed to accommodate the average thickness of the documents being fed. This differs significantly from conventional devices, wherein feed rolls are positioned by vertical motion to merely vary the pressure on the documents being fed.

After a document has passed fully over lip 16 and is urged into the tracking grooves 32 by tracking belts 50 and 51, it is now under full control of the belts. The width of the tracking plate grooves is about the same as the width of the contour plates grooves. However, the depth of the tracking plate grooves is only about two-thirds the depth of the contour plates grooves cut into the lip. The rationale for this relationship is that the document moves along the tracking plate at a high speed, such that aerodynamic forces on the document are greatly increased from those occuring at the contour plate lip. Consequently, the less the belts tend to distort the document into the tracking plate grooves, the better the control and ability to read the surface identification with electronic devices. Consequently, by decreasing the depth of the tracking plate grooves over those of the contour plate lip grooves the documents can be fed faster without skewing or jamming tendencies when ejected and stacked. It is important that a given document be sufficiently accelerated from the speed of its succeeding document, so that there is substantial separation between documents. This is to assure further separation between documents that may be of a larger size than normally used.

The reason for obtaining such separation is in order to count or read the documents individually.

As a document continues along the tracking plate it is pinched between ejection rollers 70 and the tracking belt at the belt sheaves 64. As previously noted, the pressure and location of the idler rolls 70 is substantially vertically adjustable by pivoting about an arm as indicated. Hence, again, selective pressure adjustment is used in conjunction with variation of the ejection assembly fore and aft to vary the trajectory angle of documents as they exit from the tracking plate.

While the invention has been particularly shown and described with reference to preferred embodiments thereof, it will be understood by those skilled in the art that various alterations in form and detail may be made therein without departing from the spirit and scope of the invention. For example, the multiple variations as suggested may be incorporated so as to accommodate particular types of documents; and the dual belt assembly could be altered for a multiple or perhaps even a single belt arrangement.

The embodiments of the invention in which an exclusive property or privilege is claimed is defined as follows:

1. A document handler comprising:

a tracking belt means for transporting said document at a first speed; and a slower speed feed means mounted adjacent to said higher speed tracking belt means; said slower speed feed means being adapted to move said document from a rest position to a position in engagement with said belt means so that said document is gradually accelerated from said rest position under control of said slower speed feed means to a high speed transported condition under control of said tracking belt means, said slower speed feed means continuing to engage said document during said document's initial contact with said tracking belt means to retard the document's acceleration.

2. The document handler of claim 1 wherein the ratio of speeds of the high speed tracking belt means to the slower speed feed means is about 2 to 1.

3. A document handler comprising:

a document stack hopper means defining a hopper-plate surface for supporting documents in said hopper and further including a lipped contour plate defining a lip surface adjacent to said hopper-plate surface but rising with substantial abruptness from said hopper-plate surface, to form a barrier surface which documents fed from said hopper-plate surface must climb, said lip surface forming a fillet or concave junction with said hopper-plate surface; and feed means situated adjacent said contour plate at said lip surface for engaging a document from a stack on said hopper-plate surface; driving said document toward said lip surface; and driving said document over the lip surface on said contour plate.

4. The document handler of claim 3 including a tracking plate provided with a longitudinal groove matingly positioned opposite a groove in said lip surface and a tracking belt means extending into the groove of said lip surface and the matingly positioned groove of said tracking plate.

5. The document handler of claim 4 wherein the groove of said tracking plate extends to a depth of about 5% of its width.

6. The document handler of claim 4 wherein the groove of said tracking plate is about two-thirds as deep as the corresponding groove on said lip surface.

7. The document handler of claim 6 including means to adjust the depth that the tracking belt extends into the tracking plate groove.

8. The document handler of claim 7 wherein said means to adjust depth includes rollers mounted on eccentrics and located interiorly of said tracking belt means.

9. The document handler of claim 8 including a first roller means mounted at a first location interiorly of said tracking belt means;

a second roller means mounted at a second location interiorly of said tracking belt means; and means connecting said first and second roller means.

10. The document handler of claim 4 including a cutout portion in said tracking plate to accommodate detection means for detecting the passage of documents thereover.

11. The document handler of claim 4 wherein the groove through said lip surface extends to a depth of about 75% of the height of the lip surface.

12. The document handler of claim 4 wherein the width of the groove in said lip surface is between about 3 and 25 times the depth of said groove.

13. The document handler of claim 12 wherein the width of said groove is about 14 times its depth.

14. The document handler of claim 4 wherein said hopper-plate surface is situated at a different angle with horizontal than the angle made by said tracking plate with horizontal.

15. The document handler of claim 14 wherein said hopper-plate surface makes an angle of about 12° with horizontal; and said tracking plate makes an angle of about 25° with horizontal.

16. The document handler of claim 3 wherein said lip surface includes a relatively high friction surface.

17. The document handler of claim 16 wherein said relatively high friction surface is a nitrided surface.

18. A document handler comprising:

a tracking belt assembly for moving documents along a tracking plate including a movable endless tracking belt located adjacent to a surface of said plate for holding said documents between said tracking belt and said tracking plate surface and thereby moving said documents along said surface, said assembly including an adjusting means for selectively moving said tracking belt fore and aft longitudinally of said tracking belt along said tracking plate to selectively adjust the initial point of engagement of said tracking belt assembly with a document to be fed.

19. A document handler comprising:

a document hopper forming a hopper surface for supporting documents to be fed;

a means forming a receiving surface;

a lipped contour plate located between said document hopper and said receiving surface means and forming a lip surface adjacent to said hopper surface but rising with substantial abruptness from said hopper surface to said receiving surface, thereby forming a barrier surface which documents fed from said hopper surface to said receiving surface must climb, said lip surface forming a fillet or concave junction with said hopper plate surface;

feed roller means having a feed roller thereon for engaging the foremost document of a stack thereof located in said document hopper and delivering said foremost document over said lip surface to said receiving surface; and means for adjusting said roller means fore and aft in a direction substantially parallel to the plane of said hopper surface to adjust the force with which the document to be fed engages the lip surface on said contour plate.

20. The apparatus of claim 19 wherein said receiving surface means is a tracking plate and said feed roller is located at a first end of said tracking plate and further including:

tracking belt means for transporting said document from said first end of said tracking plate toward the other end thereof;

ejection roller means located at said other end of said tracking plate for engaging a document as said document passes over said other end of said tracking plate; and means for adjusting the ejection roller means and positioning the tracking belt to vary the trajectory angle of said document as it leaves said tracking plate.

21. The document handler of claim 19 wherein said hopper surface is inclined at a different angle with the horizontal than said receiving surface.

22. The document handler of claim 21 wherein said hopper surface makes an angle of about 12° with horizontal; and said receiving surface makes an angle of about 25° with horizontal.

23. In a document handler having a first frictionally engaging feeding means operating at a relatively low speed and a second frictionally engaging feeding means operating at a higher speed, the method of handling a document comprising the steps of:

initially moving a document from a rest position by frictionally, slidably engaging said document with said relatively low speed feed means; and intercepting said document by said higher speed feed means after relatively slight initial movement of said document by said higher speed feed means and accelerating said document by frictionally, slidably engaging said document with said higher speed feed means while retarding said acceleration with said frictional, slidable engagement between said document and said relatively low speed feed means.

24. In a document handling apparatus having a first surface over which documents travel to a lipped contour plate defining a lip surface adjacent to said first surface but rising smoothly with substantial abruptness from first surface to a tracking plate surface, thereby forming a barrier surface which documents fed from said first surface to said tracking plate surface must climb, said lip surface having at least one groove therein, and a tracking plate for forming said tracking plate surface, said tracking plate surface having a tracking plate groove therein; the method of transporting a document comprising the steps of:

initially moving said document toward said groove in said lip surface at a first accelerating speed;

bending said document over said lip on said contour plate and distorting said document into said groove in said lip surface;

completing motion of said document over said lip surface at a higher speed; and distorting said document into said groove on said tracking plate while moving said document therealong at yet a higher speed.

25. The method of claim 24 including the step of simultaneously engaging said document with a relatively low speed feed means tending to drive said document at said first speed while, at the same time, engaging said document with a higher speed feed means tending to drive said document at said higher speed.

* * * * *